United States Patent [19]

Kreimer

[11] 4,069,628

[45] Jan. 24, 1978

[54] EAVE THERMAL BAFFLE FOR INSULATION

[75] Inventor: Charles Clement Kreimer, Cincinnati, Ohio

[73] Assignee: Pease Company, Hamilton, Ohio

[21] Appl. No.: 683,493

[22] Filed: May 5, 1976

[51] Int. Cl.[2] ..... E04B 1/74; F24F 7/00

[52] U.S. Cl. ..... 52/94; 52/317; 98/32

[58] Field of Search ..... 52/54, 94, 317, 95; 29/DIG. 33; 98/32, 37, 42

[56] References Cited

U.S. PATENT DOCUMENTS

| | | | |
|---|---|---|---|
| 332,491 | 12/1885 | Clay | 52/317 |
| 1,919,568 | 7/1933 | McCosh | 29/DIG. 33 |
| 3,683,785 | 8/1972 | Grange | 52/92 |
| 3,777,649 | 12/1973 | Luckey | 52/94 |
| 3,863,553 | 2/1975 | Koontz | 52/95 |

*Primary Examiner*—James L. Ridgill, Jr.
*Attorney, Agent, or Firm*—Melville, Strasser, Foster & Hoffman

[57] ABSTRACT

An eave thermal baffle for insulation adapted to be fastened on the exterior building wall and between adjacent roof framing members or other framing as may be appropriate. The baffle comprises a flat portion called the plate section adapted to lie on the top plate of the exterior wall and to be fastened thereto or placed against the exterior face of the exterior wall and to be fastened thereto. Extending vertically from this flat portion is a wall portion adapted to be fastened to the inner faces of appropriate framing members. Extending from this wall portion is a main baffle section which extends inwardly of the building and upwardly from the vertical wall. The main baffle section may also be fastened to the inner faces of a pair of appropriate framing members. Upstanding ribs extending along the sides of the main baffle section, and the main baffle section, serve to form a trough or channel for movement of ventilating air. The baffle prevents air and moisture from going in through the eave-soffit area, or the eave construction, and penetrating the insulation. The baffle assures the free movement of ventilating air into the structural cavity to assist in the removal of any moisture laden air which migrates up through the ceiling construction and to assist also in the removal of the hot air in the structural cavity caused by the "sun effect" whereby the ambient attic temperature is reduced, thereby reducing the air conditioning energy cost.

10 Claims, 4 Drawing Figures

EAVE THERMAL BAFFLE FOR INSULATION

BACKGROUND OF THE INVENTION

1. Field of the Invention

The eave thermal baffle for insulation has application to all buildings which incorporate insulation above the ceiling and is particularly suitable for use in the construction of residential buildings. The baffle permits insulation to be forced to the exterior edges of the building at the eaves, thus assuring effective insulation while maintaining its integrity by virtue of the fact that the baffle prevents the infiltration of cold air on the warm side of the insulation; this in effect does not permit a condition that will cause condensation of the moisture in the warm air migrating from the warm side of the construction which if allowed would render the insulation ineffective and damage the construction and ceiling finish in this area. Moreover, the use of the baffle further maintains the effectiveness of the insulation by preventing the insulation from being blown away from the outer perimeter of the ceiling. The baffle allows for the free flow of ventilating air through the air trough formed by the main baffle section and its upstanding ribs on each side; this feature assists in the removal of the hot air formed by the sun effect or solar radiation in the structural roof cavity (attic) whereby the attic temperature is reduced thereby reducing the air conditioning cooling load.

2. Description of the Prior Art

No search of the United States Patent Art has been conducted in connection with the eave thermal baffle for insulation comprising this invention. It is known, however, that in the past cardboard boards and the like have been inserted between the top plate of the exterior wall and the roof above in an effort to prevent insulation from spilling over. These devices were not effective to prevent penetration of the insulation by unwanted air infiltration and moisture.

SUMMARY OF THE INVENTION

An eave thermal baffle for insulation which may be readily fastened to the top plate or to the exterior face at the top of an exterior building wall and which may be fastened to and between adjacent roof framing members or other framing as may be appropriate, the baffle sloping upwardly and/or inwardly of the building so as to prevent air and moisture from penetrating into insulation disposed against and beneath the baffle while still allowing the free passage of ventilating air above, between the baffle and the surface immediately above. The baffle may be placed while the building is under construction and before the inner ceiling thereof is installed. The baffle may be put in place by an operator working from within the building. The baffle provides a suitable trough for the passage of air from the eave-soffit area but without such air and entrained moisture penetrating into the insulation. The baffle may be comprised of any suitable material and lends itself quite readily to being construted of cardboard which may be scored, and cut-scored, to define the various baffle parts. In a preferred embodiment these parts may comprise a horizontal portion to rest on the top plate of the exterior wall and be fastened to the top of the top plate or may be placed in the plane of the exterior surface on the face of the exterior wall and be fastened to the face of the exterior wall, a vertical wall adjacent the outer wall of the building, a pair of inturned flaps extending from the vertical wall and adapted to be secured to the inner faces of adjacent roof framing members or other framing as may be appropriate, a main wall extending from the top of the vertical wall into the interior of the building at an appropriate angle, upstanding ribs along the edge of the main baffle wall to insure its spacing from the surface immediately above so as to provide an air trough, and downwardly depending tabs extending from the interior end of the main baffle wall and adapted to be secured as desired to the inner faces of the adjacent roof framing members or other framing as may be appropriate. After the baffle is installed the ceiling may be placed and insulation jammed into position against the vertical baffle wall.

DESCRIPTION OF THE PREFERRED EMBODIMENTS

Figure 2:
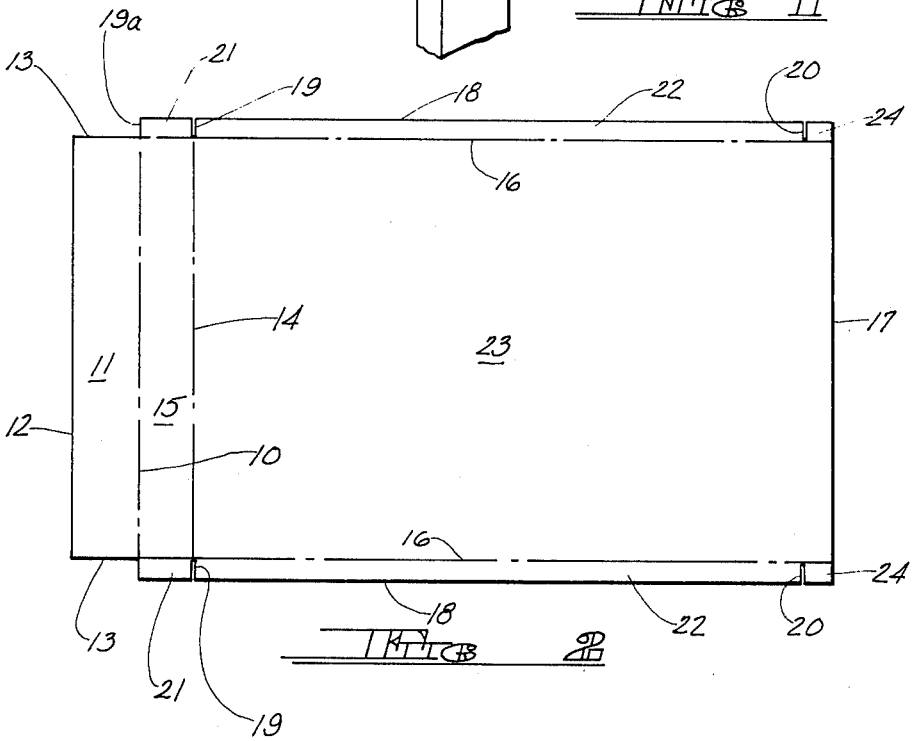
FIG. 2 is a plan view of the principle baffle member, scored and cut-scored, to define the desired baffle parts.

The blank from which the eave thermal baffle for insulation may readily be constructed is depicted in FIG. 2. A typical blank, but by way of example only, may have an overall width of 24 and $\frac{3}{8}$ inches and an overall length of 40 inches. At one end the blank is scored across the width thereof at a distance of 3 and $\frac{1}{2}$ inches from such end. This score line is designated by the reference numberal 10. This score line 10 defines a first panel 11 having an outer edge 12. Segments 1 inch wide are cut off the panel 11 at the ends thereof between the reference numerals 10 and 12 as indicated at 13. In the example given, therefore, the width of the panel 11 between the reference numerals 13 will be 22 and $\frac{3}{8}$ inches. This width will fit in the space commonly used for the spacing between adjacent roof trusses.

The blank is also scored at 14 to provide a panel 15 adjacent the panel 11. This panel will eventually be the upstanding vertical exterior wall of the baffle to be formed from the blank.

The blank is also provided with a pair of cut-score lines 16 extending from the score line 10 to the other end 17 of the blank. These cut-score lines 16 are preferably located 1 inch from the sides 18 of the blank. Pairs of cuts 19 and 20 extend from the outer edges 18 to the cut-score lines 16. These cuts 19 and 20, along with the cut-score lines 16, define flaps 21 at each end of the panel 15, ribs 22 along the sides of the main baffle wall 23, and tabs 24 adjacent the end 17 of the baffle.

In the typical baffle being described, the panel 11 will be 3 $\frac{1}{2}$ inches wide, the panel 15 will be 2 $\frac{3}{4}$ inches wide and the distance from the score line 14 to the end 17 will be 33 and $\frac{3}{4}$ inches. The opposite dimensions of each of the panels 11, 15 and 23 will be 22 and $\frac{3}{8}$ inches. The flaps 21 will measure 1 inch by 2 and $\frac{3}{4}$ inches, the ribs will measure 1 inch by 31 and $\frac{3}{4}$ inches, and the tabs 24 will measure 1 inch by 2 inches. These dimensions, however, are not critical but they are representative of a satisfactory eave thermal baffle according to this invention.

Figure 1:
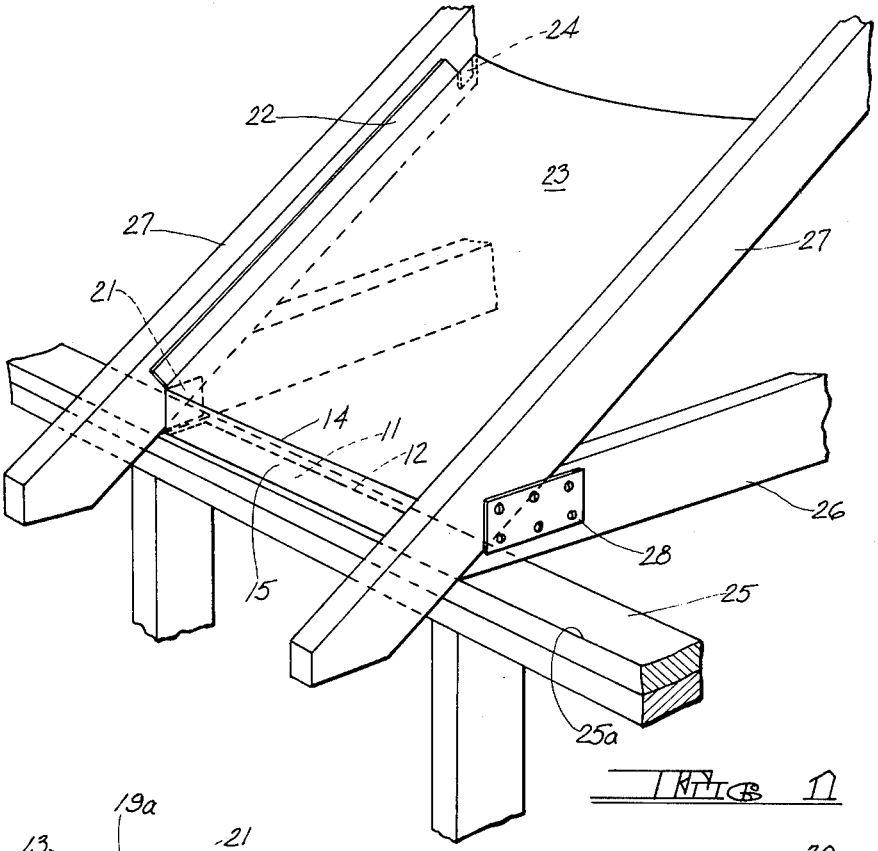
FIG. 1 is a perspective view of a portion of a building under construction showing the eave thermal baffle for insulation installed between adjacent roof framing members.

In FIG. 1 the top plate of an exterior wall is designated by the reference numeral 25. A pair of adjacent roof framing members comprised of a lower chord 26 and an upper chord 27 are indicated as joined by a suitable fastener plate 28. In the example being described the distance between pairs of adjacent roof framing members 26, 27 is about 22 and ½ inches. In any event the baffle comprised of the panels 11, 15, and 23 will be designed to fit just nicely between adjacent roof framing members 26, 27.

Figure 3:
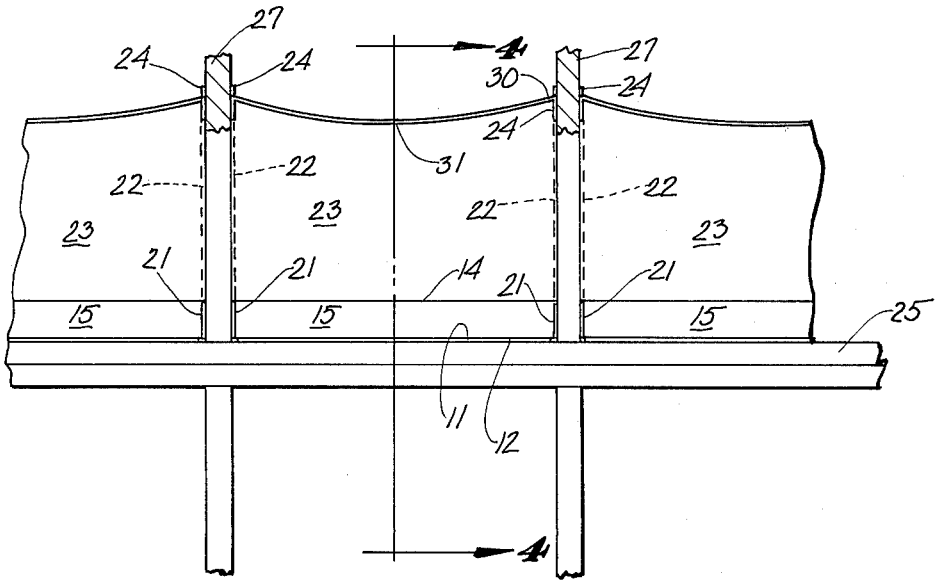
FIG. 3 is an elevation of a side of a building as seen from the inside thereof and depicting the eave thermal baffle for insulation in place between a pair of roof trusses and extending from the top plate of the exterior building wall.
Figure 4:
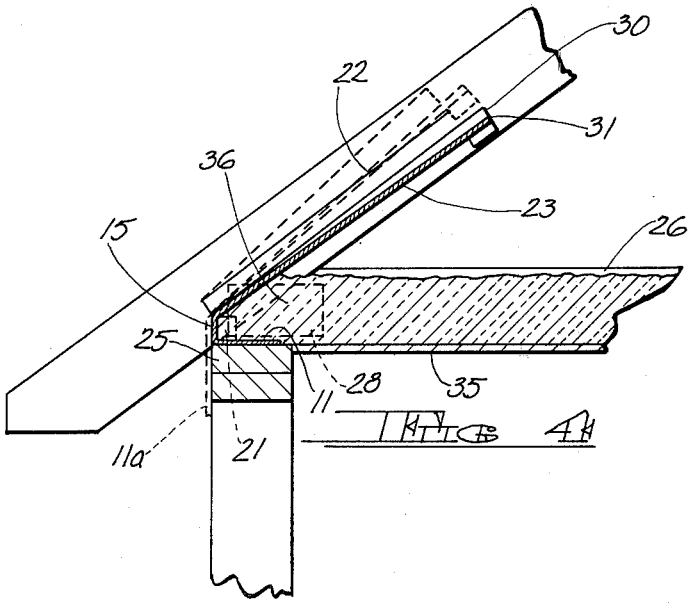
FIG. 4 is a section taken on the line 4—4 of FIG. 3.

FIGS. 1, 3 and 4 all illustrate the eave thermal baffle as installed. The panel 11 will lie flat on the top of top plate 25, or it may be placed against the exterior face of the exterior wall framing on the vertical exterior face of top plate 25, as indicated at 11*a* in FIG. 4, and on which wall sheathing and/or siding could have been previously applied, and it will be secured thereto by any suitable means such as by stapling, by nailing and/or by glue and the like. Usually the panel 11 will cover most of the top face of the top plate 25 when applied on top of the top plate. The baffle will be bent about the score lines 10 and 14 so that the panel 15 is substantially vertical and it will be substantially at the outside edge 25*a* of the top plate. The flaps 21 will be turned inwardly of the building at right angles to the panel 15 and these flaps will be secured to the inner faces of the adjacent roof framing members 27 again as by stapling, nailing and/or glue and the like. The main body panel 23 will slope inwardly and upwardly from the score line 14 at any desired angle. This may be determined by the points at which the tabs 24 are connected to the inner faces of the adjacent roof framing members 27 again as by stapling, nailing and/or glue and the like. It will be understood that normally the roof framing members 27 will be in place when the eave thermal baffle is put in place and roofing material may have all ready been placed on and over the members 27. The upstanding ribs 22 insure that the panel 23 will be spaced from the surface above so as to provide an air passage leading from the eave-soffit area over the baffle members 15 and 23.

After the eave thermal baffle has been installed in the manner above indicated, ceiling materials may be fastened to the bottom of the ceiling or roof framing members 26 and insulation placed thereon. Such insulation may be in the form of mats or it may be material that is blown into place. In any event the insulation may be jammed against the interior vertical wall 15 of the baffle. It will immediately be evident that this baffle prevents cold air and the like from contacting the warm side of the insulation which is disposed along the eave side of the building. In the past, without the protection afforded by the baffle of the instant invention, insulation near the eave was often penetrated with cold air and the like and rendered inefficient by the accumulation of, or absorption of, moisture in the insulation caused by the condensation of the moisture in the warm air migrating from the warm side of the construction; also the penetration of cold area under the insulation would form a cold ceiling in this area, thus negating the insulation. The present eave thermal baffle, in addition to protecting that insulation which is towards the eave, also provides for movement of air from the eave-soffit area by letting the air pass over the vertical baffle wall 15 and around the outside of the main baffle panel 23 into the roof or attic cavity well away from the insulation disposed on the ceiling materials. As earlier indicated, the inward extent of the baffle panel 23 may be determined by the particular builder erecting the building. The earlier dimensions given were by way of example only, although they have proved to be successful in practice.

As indicated by the points 30 and 31 in FIGS. 3 and 4, there may be a slight "bow" in the panel 23 when it is installed between the roof framing members 27. It will be understood that while the eave thermal baffle may be made of any desired material, cardboard, treated or untreated, has proved quite satisfactory and economical. In a preferred embodiment that side of the panels 11, 15 and 23 which faces inwardly towards the ceiling material will be printed while that side which faces towards the roofing material may be coated so as to be weather resistant. Any of the well known coatings for weather-proofing may be employed.

FIG. 3 illustrates a plurality of the eave theremal baffles of this invention placed between successive pairs of adjacent roof framing members. FIG. 4 shows a more complete installation including a ceiling member 35 and insulation 36. The flap 21 and connector plate 28 in FIG. 4 are shown in dotted lines by reason of their being obscured by the insulation material 36.

It will be apparent to those skilled in the art that modifications may be made in this invention without departing from the scope and spirit thereof. If desired, the material removed adjacent the ends 13 of the panel 11 could be left intact and a cut provided at 19*a* whereby extra flaps extending at right angles to the bottom panel 11 would come into being and could be used to further secure the baffle to the inner face of the lower roof framing members 26. Preferably, however, such extra flaps are not utilized for it has been found that they are more of an obstruction than are they a help. It is also possible that the cut 20 and resulting tabs 24 could be omitted and the ribs 22 could be used to fasten the baffle in place at the desired angle. This, however, is somewhat awkard and the depending tabs 24 are much more readily used. As indicated, materials other than cardboard may be used if desired. The ribs 22, in addition to providing a path for the movement of air from the eave-soffit area, serve also to strengthen the main panel section 23.

It is to be further understood that while the invention has been shown and described in connection with particular structures and arrangements, and dimensions, such structures and arrangements, and dimensions, are not to be taken as limitations on the invention except insofar as they are specifically set forth in the subjoined claims:

The embodiments of the invention in which an exclusive property or privilege is claimed are defined as follows:

1. An eave thermal baffle comprising a bottom panel to rest on and be secured to the top face of a top plate of an exterior wall of a building, or to be placed against and to be secured to the exterior face of the exterior wall of a building and the like; a rear panel extending upwardly from said bottom panel adjacent the outer edge of said top plate, or adjacent the exterior face of the exterior wall; and a top panel extending from the top of said rear panel and from said botton panel inwardly of said building; said baffle being of a width adapted to just nicely span the distance between adjacent roof framing members or other framing as may be appropriate; whereby air and the like is prevented by said rear panel and said top panel from passing from the eave-soffif area into contact with or under insulation disposed within said building against said baffle.

2. The baffle of claim 1 including a flap at right angles to said rear panel and adapted to be secured to the inner face of a said framing member.

3. The baffle of claim 1 including a rib extending along an edge of said top panel at right angles thereto and adjacent the inner face of a said framing member.

4. The eave thermal baffle of claim 1 including a flap at each edge of said rear panel and at right angles thereto, each said flap being adapted to be secured to an adjacent roof framing member or other framing as may be appropriate, an upstanding rib extending along each edge of said top panel adjacent the inner face of a said framing member, and a depending tab at each side of said top panel and adapted to be secured to the inner face of a said framing member.

5. The baffle of claim 1 including a depending tab extending at right angles to said top panel and adapted to be secured to the inner face of a said framing member.

6. The baffle of claim 5 which said tab is located at the end of said top panel remote from said rear panel.

7. An eave thermal baffle for insulation, for use in a building having a ceiling and a roof defining an attic cavity area, comprising: a first panel to be secured adjacent the top side or top exterior face of an exterior wall of the building; a second panel extending upwardly from said first panel; a third panel extending from said second panel and from said first panel into the attic cavity area between the ceiling and the roof; said baffle being of a width adapted to just nicely span the distance between adjacent roof framing members; and means to secure said baffle between the roof framing members so as to provide an air passage from the eave-soffit area of the building over the top of said third panel into said attic cavity area; whereby ventilation to the unheated or uncooled attic cavity area is assured while at the same time providing a cover for insulation installed adjacent the outer perimeter of the ceiling.

8. The baffle of claim 7 comprised of a unitary blank provided with score lines and cuts whereby said first, second, and third panels are hingedly connected together.

9. An eave thermal baffle for insulation, for mounting over an exterior wall and between a roof and ceiling of a building stucture, to provide an air passage between the roof and ceiling and overall insulation applied to the ceiling, and to prevent insulation from spilling over said wall, the said building structure including parallel roof framing members spaced from each other and supported on said wall, said eave thermal baffle comprising: a first panel to be secured adjacent the top side or against the top exterior face of said exterior wall; a second panel extending upwardly from said first panel; a third panel extending from said second panel and from said first panel into the attic cavity area between said ceiling and said roof; said baffle being of a width adapted to just nicely span the distance between adjacent of said roof framing members; and means to secure said baffle between said roof framing members so as to provide an air passage from the eave-soffit area of the building structure over the top of said third pannel into said attic cavity area; whereby ventilation to the unheated or uncooled attic cavity area is assured while at the same time providng a cover for insulation installed adjacent the outer perimeter of the ceiling.

10. In a building, an exterior wall, a series of generally parallel spaced roof framing members supported on said wall, an eave-soffit area adjacent said wall, a roof supported on said framing members, and a ceiling, said roof and said ceiling defining an attic cavity area; and an eave thermal baffle for insulation, for use in said building, said baffle comprising: a first panel to be secured on the top or exterior top face of said wall; a second panel extending upwardly from said first panel; a third panel extending from said second panel and from said first panel into said attic cavity area between said ceiling and said roof; said baffle being of a width adapted to just nicely span the distance between adjacent of said roof framing members; and means to secure said baffle between said roof framing members so as to provide an air passage from said eave-soffit area over the top of said third panel into said attic cavity area; whereby ventilation to the unheated or uncooled attic cavity area is assured while at the same time providing a cover for insulation installed adjacent the outer perimeter of said ceiling.

* * * * *

UNITED STATES PATENT OFFICE

CERTIFICATE OF CORRECTION

Patent No. 4,069,628 Dated January 24, 1978

Inventor(s) CHARLES CLEMENT KREIMER

It is certified that error appears in the above-identified patent and that said Letters Patent are hereby corrected as shown below:

Column 5, line 22 the word --in-- should be inserted immediately after the numeral 5.

Column 6, line 4 the word "overall" should be --over--.

Signed and Sealed this

Fifth Day of September 1978

[SEAL]

*Attest:*

RUTH C. MASON
*Attesting Officer*

DONALD W. BANNER
*Commissioner of Patents and Trademarks*